United States Patent [19]

Tamez

[11] 4,183,497

[45] Jan. 15, 1980

[54] CHAMFER STRIP FOR CONCRETE STRUCTURES

[76] Inventor: Daniel Tamez, 6305 Tulsa, Apt. #4, Houston, Tex. 77092

[21] Appl. No.: 941,225

[22] Filed: Sep. 11, 1978

[51] Int. Cl.[2] ..... E04G 11/06; E04G 11/08

[52] U.S. Cl. ..... 249/205; 249/188; 249/192; 249/193; 249/194

[58] Field of Search ..... 249/188, 192, 193, 194, 249/205

[56] References Cited

U.S. PATENT DOCUMENTS

| | | | |
|---|---|---|---|
| 2,718,685 | 9/1955 | Mitchell | 249/188 |
| 2,940,152 | 6/1960 | Riehl | 249/194 |
| 2,991,532 | 7/1961 | Stiles | 249/188 |
| 3,782,680 | 1/1974 | Hopkins | 249/188 |

*Primary Examiner*—Lester L. Lee

*Attorney, Agent, or Firm*—Charles H. De La Garza

[57] ABSTRACT

There is disclosed a chamfer device for use in the construction of concrete structures having chamferred edges. The chamfer device is adapted to be affixed to a support structure and the device is adapted to receive and support in a concrete sealing relationship the upright edge of a nominally sized two inch form of lumber.

6 Claims, 3 Drawing Figures

FIG. 1
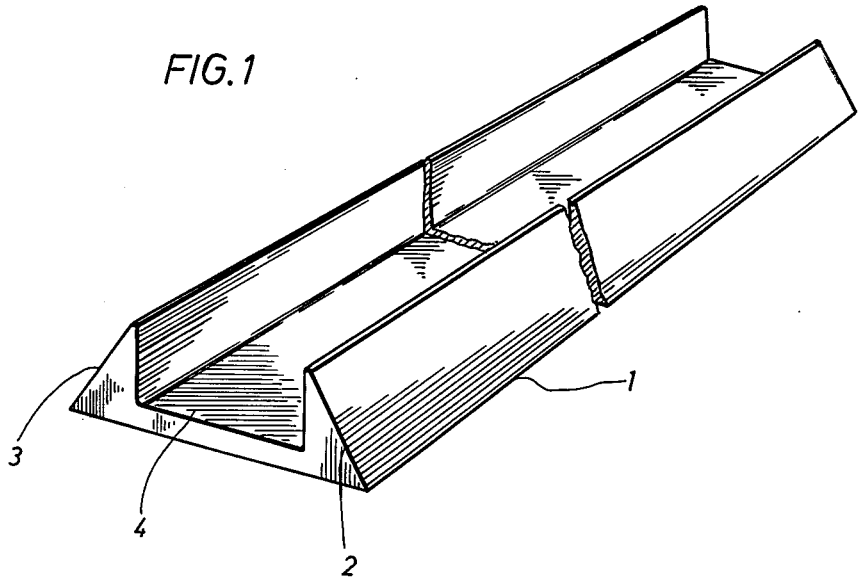
FIG. 2
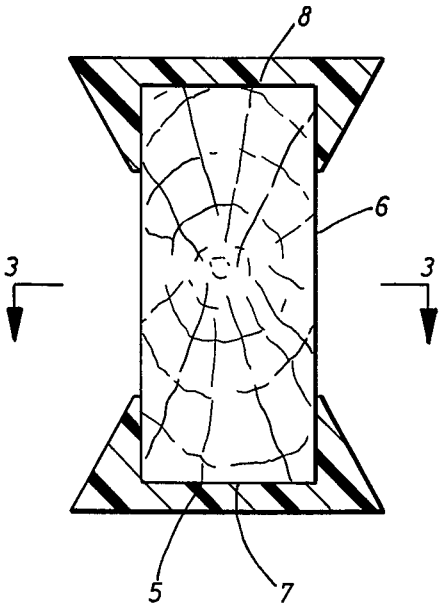
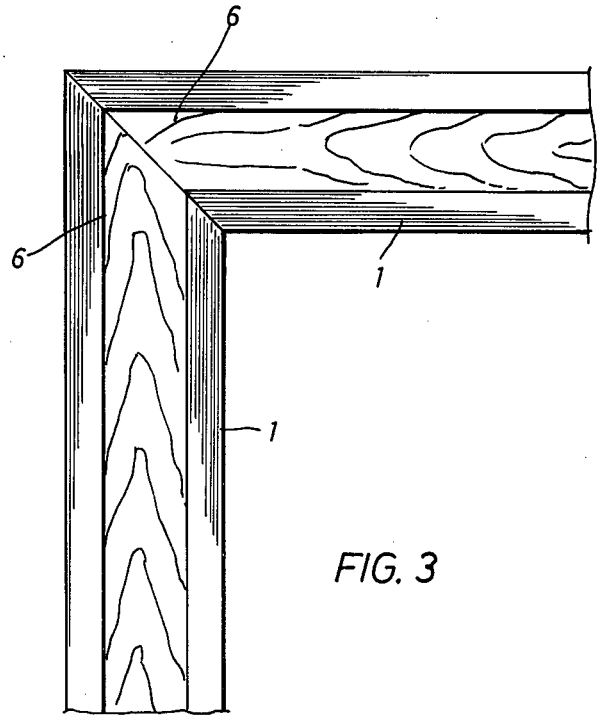
FIG. 3

CHAMFER STRIP FOR CONCRETE STRUCTURES

BACKGROUND

In the construction of concrete structures and, in particular, in the construction of concrete wall panels it is well known in the art that it is desirable to provide a chamfer adjacent all edges of the concrete casting so that the structure will not require further finishing and so that the edges will be sufficiently strong and not easily broken by accidental impact.

In the formation of concrete wall panels one method which has been successfully employed is that of forming the concrete wall panels on their sides atop a suitable support structure. In setting up the form used to retain the poured concrete, one method which has been employed is quite time-consuming and wasteful of materials. In this previously employed method, the perimeter of the wall to be formed is marked out on a suitable support structure, e.g., a concrete slab. Holes are then drilled a predetermined distance from each other along the marked perimeter. Then, the lumber forms which are to be used in retaining the concrete are aligned adjacent the marked perimeter. Marks are made on the lumber which correspond to the holes drilled along the perimeter. Next, holes are drilled in the lumber at each marked location. Long nails or the like are then placed in the upright holes made in the concrete slab and the forms are then placed upon and retained in position by the nails. At each corner of the form, the lumber forms are mitered and nailed at a right angles to each other.

Once the lumber forms have been set in place, wooden chamfer strips are nailed to the inside perimeter of the lumber forms both at the top and bottom edges. By affixing these chamfer strips to the forms, the formed concrete wall will have all edges chamferred.

The above-described method of forming wall panels utilizes a wooden lumber form and wooden triangular shaped chamfer strips which are attached together prior to the casting of the concrete structure. Other types of chamfer strips have been disclosed in the art. For example, U.S. Pat. No. 2,940,152 discloses a chamfer strip which has an edge that may be attached to a mold. The chamfer strip disclosed in that patent must be nailed or otherwise affixed to the form and that strip is not adapted to receive and support the form.

U.S. Pat. No. 2,718,685 discloses a chamfer strip which is arranged as a frame mountable in a form to provide chamferring at the top of the casting. The device is described in that patent as being one which is adapted to receive and secure a chamfer strip or which is used in those instances where a chamfer strip had already been placed in the form.

U.S. Pat. No. 2,991,532 discloses a chamfer strip which includes two members. One member is a bracket which is detachably secured to a form and the other member is a concrete molding surface which can be attached to the secured bracket. In that patent it is disclosed that the concrete molding form can be of any suitable configuration and either member of the chamfer strip can be of sheet metal or of a molded or extruded synthetic material such as methyl methacrylate.

U.S. Pat. No. 3,782,680 discloses a chamfer strip which may be used for locating a concrete form used in the construction of monolithic slab and beam construction. The chamfer strip disclosed in that patent is utilized in concrete construction where a U-shaped pan is employed to form a void area in the concrete. The chamfer strip is described as having a flat base portion, a chamfer portion extending angularly upwardly from the base portion at one end thereof, and a ridge portion extending upwardly from the base portion and spaced from the chamfer portion, wherein the base portion extends beyond the ridge portion to provide an attachment means for securement of the chamfer strip to a support structure. It is further disclosed that the chamfer strip may be formed integrally of a plastic material from the group consisiting of acrylonitrilebutadiene-styrene, polystyrene, polyethylene and polyurethane. The ridge portion and the chamfer portion are disclosed as being spaced so that a longitudinal groove is formed for receiving the upright edge of the form.

The devices and methods which were utilized in the prior art have many disadvantages. Some of the prior art devices appear to be expensive to manufacture. Others, while apparently inexpensively manufactured are disadvantageous in that they are not easily placed into proper position. Because of this, labor costs are significantly increased when those devices are used. Another disadvantage is that no device has been provided which is adapted to receive and support a nominally sized two inch form of lumber. Furthermore, no provision has been made in the prior art from casting multiple concrete structures while simultaneously using the same chamfer device.

SUMMARY OF THE INVENTION

This invention has overcome the disadvantages inherent in prior art devices. There is provided a chamfer device for use in holding a form used in the construction of concrete structures. The device comprises an elongated strip which is adapted to be affixed to a support structure and which strip has two parallel chamfers spaced apart by a distance sufficient to define a longitudinal channel adapted to receive and support an upright edge of a nominally sized two inch form of lumber. The chamfers of the strip are oriented such that the exterior longitudinal edges of the strip are bevelled. Further, the longitudinal channel is of a size which not only is able to receive and support a nominally sized two inch form of lumber but which also serves this function in a concrete sealing relationship, that is, once the lumber form is placed in the elongated strip and the concrete is poured in place, the relatively tight fit between the channel and the lumber prevents concrete from entering the channel.

The device of the instant invention may be of any suitable material. Preferably, the device is of unitary construction and is made of a molded or extruded plastic material. The plastic material should be of any suitable type which allows the base of the longitudinal channel to be penetrated by a nail or other securing object to affix the elongated strip to a support structure. The plastic material should also be sufficiently strong to hold lumber forms and sufficiently durable to be reused if required.

The instant invention also provides a form which may be utilized in the construction of concrete structures having bevelled edges. The form comprises in combination: a nominally sized two inch form of lumber; and, a first elongated strip adapted to be fixed to a support structure and having two parallel chamfers spaced apart by a distance sufficient to define a longitudinal channel adapted to receive and support the upright bottom edge of the form of lumber; and, a second elongated strip adapted to be affixed to the form of lumber and having two parallel chamfers spaced apart by a distance sufficient to define a longitudinal channel adapted to receive the upright top edge of the form of lumber. The chamfers of each of the strips are oriented such that the exterior longitudinal edges of the strips are bevelled. Further, the channels of each of the strips are sized such that they receive a nominally sized two inch form of lumber in a concrete sealing relationship.

BRIEF DESCRIPTION OF THE DRAWINGS

The invention will be more fully understood and appreciated from the following detailed description of a preferred embodiment taken in connection with the accompanying drawings, in which:

FIG. 1 is a prospective view of a portion of the chamfer strip of the instant invention;

FIG. 2 is a sectional view illustrating a form for use in constructing concrete structures which embodies the teaching of this invention; and FIG. 3 is a sectional view taken on a line 3—3 in FIG. 2.

DESCRIPTION OF THE PREFERRED EMBODIMENT

Throughout the following description, similar reference numerals refer to similar elements in all figures of the drawings.

Referring to FIG. 1, there is illustrated the preferred embodiment of the novel chamfer strip of the instant invention. The preferred chamfer strip 1 is shown to include two chamfers 2 and 3 respectively which are parallel to each other and which define a channel 4 which has a base 5. In the preferred embodiment, the chamfer strip is affixed in some suitable manner such as by nailing to a support structure. The base of the channel 5 is adapted to be penetrated by nails or other affixing or fastening means. Although it is preferred to nail the chamfer strip to a support structure through the base 5 the nails may be placed through the chamfer strip at any other location.

The chamferred, bevelled, edges of the strip are illustrated to be substantially triangular in shape. However, the chamferred portion of the novel device may be of any desired configuration including concave, convex, or stepped.

The base 5 may be provided with openings (not shown) through which affixing or fastening members such as nails may be placed.

The channel 4 is sized to receive and support an upright edge of a nominally sized two inch form of lumber. By "nominally sized two inch form of lumber" it should be understood that lumber which is generally available is often referred to as having a nominal width of two inches. However, in reality, these "two inch wide" pieces of lumber have a width of approximately one and three quarters ($1\frac{3}{4}$) inches. Thus, it will be understood that whenever reference is made throughout this specification to a nominally sized two inch form of lumber, that the width of the lumber is as stated above.

The channel 4 is of a size not only sufficient to receive and support a nominally sized two inch form of lumber but it does this in a concrete sealing relationship. By this it is meant that the lumber and chamfers strip are sufficiently tightly fit such that when concrete is poured into the form, as substantial amount of concrete enters the channel 4 which holds the lumber form.

Referring now to FIG. 2, there is shown an end view of the preferred embodiment of a form of the instant invention. The form comprises a nominally sized two inch piece of lumber 6. Any suitably sized piece of lumber such as a 2×4, 2×6, 2×8, 2×12, etc. may be utilized depending on the particular concrete structure to be formed. Again, it should be understood that when the words "nominally sized two inch form of lumber" are used, that reference is made to the industry standard of lumber as having a width of two inches when in reality the lumber has a width of approximately $1\frac{3}{4}$ inches. Thus, it will be understood that whenever reference is made to a nominally size two inch form of lumber that what is meant is a piece of lumber having the width described above.

Referring again to FIG. 2, there is shown a nominally sized two inch form of lumber in comnbination with two chamfer strips 1 and 1 which are similar to chamfers strip 1 shown in FIG. 1. In practical application, the form shown in FIG. 2 is not of a unitary construction; rather, in the preferred embodiment the bottom chamfer strip is affixed to a support structure by driving nails through the base of the channel 5. Once the bottom chamfer strip is nailed in place, the bottom upright edge 7 of the nominally sized two inch form of lumber 6 is placed into the channel of nailed chamfer strip and supported thereby. After the form of lumber 6 is placed into the nailed chamfer strip another chamfer strip is placed on the top upright edge 8 of the form of lumber 6. In each instance, the chamfer strips are designed such that when concrete is poured into the space defined by forms similar to that illustrated in FIG. 2, no substantial amount of concrete leaks into either of the channels of either chamfer strips because of the relatively tight fit. Thus, it may be said that the chamfer strips hold the form of lumber in a concrete sealing relationship.

The preferred use of the chamfer strips of the instant invention is in casting concrete wall panels. The concrete wall panels are formed on their sides and on a suitable support structure such as a concrete slab. This method of forming wall panels on their sides is well known in the art but will nonetheless be briefly described here.

In preparing the form to be used in casting the concrete wall panel, an outline is marked on the concrete slab. For example, if the wall panel is rectangular in shape a rectangularly shaped outline of the wall is marked on the concrete slab. Next, a chamfer strip such as shown in FIG. 1 may be nailed or otherwise suitably affixed to the concrete slab along one side of the marked wall outline. It should be apparent that each side of the wall may need one or more chamfer strips joined in any suitable splicing manner to form that edge of the form. Chamfer strips may be affixed along the other edges of the wall panel as outlined on the concrete slab.

Reference should now be made to FIG. 3 of the drawings wherein the joining of the chamfer strips at a corner is illustrated. The chamfer strips as shown are mitered and positioned at right angles to each other. This joining of strips should be carefully undertaken so that no gaps remain through which the poured concrete can escape. It should also be apparent from the drawing of FIG. 3 that the forms of lumber 6 must also be mitered at the corners. It should also be appreciated from FIG. 3 that one chamfer strip can be suitably spliced to another at angles other than right angles.

Once the forms of lumber are positioned and mitered at the corners, then chamfer strips may be placed on top of the forms of lumber around the entire perimeter of the form. Again, depending on the length of the chamfer strips and on the dimensions of the wall, each edge of the form may need more than one chamfer strip. The strips should be suitably spliced so that no gaps remain through which the poured concrete can escape. These chamfer strips must also be mitered at their corners.

Once the forms are in place as described above suitable reinforcing steel may then be located by any conventional manner. Prior to pouring the concrete into the form, the inside of the form and the concrete slab within the form should be sprayed with a light oil or other suitable material so as to minimize any sticking of the poured concrete to the mold or to the concrete slab.

It should be appreciated that the form which is made to receive and retain concrete for the making of a wall panel may also serve an addition function due to a unique feature of the chamfer strips of the instant invention. Since both sides of the chamfer strip are bevelled, it should be appreciated that each edge of the form may serve as an edge for another concrete wall panel. That is, two wall panels can be simultaneously made by utilizing one edge of the form as a common edge between both forms.

The chamfer strip of the instant invention in its preferred embodiment is relatively light in weight but sufficiently strong to receive and support a lumber form and to restrain concrete when poured into the form. It should be understood that the chamfer strip of the instant invention may make various surfaces on the chamferred edges of the formed concrete other than a straighht chamferred edge similar to that which would be made if the strip shown in FIG. 1 were employed. These surfaces include but are not limited to those which are convex, concave, or stepped.

The chamfer strip of the instant invention may be made from any material including extruded or molded plastic material such as polyethylene, polystryene, polyurethane or of any other suitable plastic material. Preferably the chamfer strip of the instant invention is of a unitary construction and made of an extruded plyethylene. The material used in making the chamfer device of the instant invention should be of a type which can be penetrated by a nail or other affixment means without irreparably damaging the device.

The description of the preferred embodiment of the instant invention was not intended to limit the scope of the invention. Various modifications of the disclosed embodiment of the invention may be apparent to persons skilled in the art upon reference to this disclosure. It is therefore contemplated that the appended claims cover any such modifications or embodiments as fall within the true spirit of this invention.

What is claimed is:

1. A chamfer device for use in the construction of concrete structures having bevelled edges which comprises:

an elongated strip having two parallel chamfers spaced apart by a distance sufficient to form a longitudinal channel adapted to receive in a concrete sealing relationship the upright edge of a nominally sized two inch form of lumber, said chamfers oriented such that the exterior longitudinal edges of said strip are bevelled, said strip adapted to be attached to a support structure.

2. The device of claim 1 wherein said strip is of a unitary construction and is of a material selected from the group consisting of polyethylene, polystyrene and polyurethane.

3. The device of claim 2 wherein the bases of said channel is penetrable by a nail for affixment of said device to said support structure.

4. A device for use in the construction of concrete structures having bevelled edges which comprises in combination:

a nominally sized two inch form of lumber;

a first elongated strip adapted to be affixed to a support structure, said strip having two parallel chamfers spaced apart by a distance sufficient to define a longitudinal channel adapted to receive and support in a concrete sealing relationship the upright bottom edge of said form of lumber, said chamfers oriented such that the exterior longitudinal edges of said strip are bevelled; and a second elongated strip adapted to be affixed to a form of lumber, said strip having two parallel chamfers spaced apart by a distance sufficient to define a longitudinal channel adapted to receive in a concrete sealing relationship the upright top edge of said form of lumber, said chamfers oriented such that the exterior longitudinal edges of said strip are bevelled.

5. The device of claim 4 wherein said strips are of a unitary construction and are of a material selected from the group consisting of polyethylene, polystyrene and polyurethane.

6. The device of claim 5 where the bases of said channels are penetrable by a nail.

* * * * *